US006536686B2

(12) United States Patent
Dukes et al.

(10) Patent No.: US 6,536,686 B2
(45) Date of Patent: Mar. 25, 2003

(54) HAND ACTIVATED DISPENSING PUMP HAVING SPRAYER/FOAMER SELECTOR WHEEL

(75) Inventors: Stephen A. Dukes, North Baltimore, OH (US); Martin S. Laffey, Sylvania, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 10/100,317

(22) Filed: Mar. 18, 2002

(65) Prior Publication Data

US 2002/0092927 A1 Jul. 18, 2002

Related U.S. Application Data

(63) Continuation of application No. 09/753,648, filed on Jan. 3, 2001, now Pat. No. 6,382,527.

(51) Int. Cl.[7] ..... B05B 7/30

(52) U.S. Cl. ..... 239/343; 239/333; 239/391; 239/436

(58) Field of Search ..... 239/333, 335, 239/343, 358, 390, 391, 392, 394, 436; 222/190, 380, 383.1; D9/300, 448; D23/225

(56) References Cited

U.S. PATENT DOCUMENTS

| | | | | | |
|---|---|---|---|---|---|
| 2,790,680 | A | * | 4/1957 | Rosholt | 239/394 |
| 3,982,698 | A | * | 9/1976 | Anderson | 239/394 |
| 4,247,048 | A | * | 1/1981 | Hayes | 239/333 |
| 5,664,732 | A | * | 9/1997 | Smolen et al. | 239/333 |
| 5,878,959 | A | * | 3/1999 | Smolen et al. | 239/333 |
| D418,755 | S | * | 1/2000 | Durliat | D9/448 |
| 6,382,527 | B1 | * | 5/2002 | Dukes et al. | 222/383.1 |

* cited by examiner

*Primary Examiner*—Robin O. Evans

(57) ABSTRACT

The selector wheel is mounted to rotate about the axis of the nozzle cap, and a spray window and foaming sleeve are formed in the wheel offset from the axis. The window or sleeve is registrable with the offset spray orifice by rotating the wheel. Either window or sleeve can be brought into registry so that the discharge is spray or foam.

8 Claims, 2 Drawing Sheets

HAND ACTIVATED DISPENSING PUMP HAVING SPRAYER/FOAMER SELECTOR WHEEL

CROSS REFERENCE TO RELATED APPLICATIONS

This application is a continuation of application Ser. No. 09/753,648 filed Jan. 3, 2001 now U.S. Pat. No. 6,382,527.

FIELD OF THE INVENTION

This invention relates to hand-operated dispensing pumps sometimes called trigger sprayers. More specifically, this invention relates to trigger sprayers adapted to selectively emit a spray cone or a foaming discharge.

BACKGROUND OF THE INVENTION

The prior art is replete with trigger sprayers of various types. An example is disclosed in the McKinney U.S. Pat. No. 4,161,288 wherein the pump comprises a vertically disposed cylinder having a piston stroking as a trigger lever is pulled back and forth. This pumps the liquid from an attached container out a delivery tube to a nozzle.

Typically, trigger sprayers are provided with a nozzle including a rotatable nozzle cap. The delivery tube from the pump usually terminates in a bushing and the cap snaps over the bushing. The delivery tube passes the liquid toward the front end of the cap where it is usually introduced tangentially into a so-called "swirl chamber" on the rear face of the front end of the cap. In the chamber the liquid increases in angular velocity as it swirls toward the orifice and finally discharges in the form of a spray cone.

A shut-off valve may be provided between the bushing and nozzle cap wherein channels in the respective parts align in use, but the flow may be cut off by rotating the cap to a "stop" position wherein the channels do not align.

In some sprayers the orifice and swirl chamber have been offset from the axis of the cap. In the Hayes U.S. Pat. No. 4,247,048, for instance, the orifice is offset and the discharge may selectively be in the form of a stream or a spray, depending on the depth of the channel on the delivery tube where it communicates with the swirl chamber.

The concept of a foaming sleeve surrounding the spray cone emitting from a trigger pump orifice is disclosed in the Shay U.S. Pat. No. 4,669,665. Here the cone engages the inside of the foaming sleeve, mixes with air, and discharges as a foam.

The further Shay U.S. Pat. No. 4,768,717 issued Sep. 6, 1988 teaches the idea of introducing air inwardly about the outside of a foaming sleeve to the rear end of the sleeve to enhance the foaming.

A number of prior patents have suggested means in a trigger sprayer for selecting either a foam or a spray type discharge. An example is disclosed in the Shay U.S. Pat. No. 4,767,060 wherein a foaming collar is reciprocably mounted on an annular support extending forward from the nozzle. The sleeve can be moved into either a forward position wherein it is engaged by the emitting spray cone produces foam, and a rearward position adjacent the orifice wherein the collar is not contacted by the spray, and the discharge is in the form of a spray.

A further disclosure of a selectable spray or foam discharge is found in the Corsette U.S. Pat. No. 4,779,803 wherein a centrally apertured plate has a plurality of rearward legs which telescope into the nozzle cap about the orifice. The plate is movable as the legs slide into the cap or out from it. The plate can be set in a position where the aperture is adjacent the orifice and does not interfere with the spray or is away from the orifice, forward of it, and is impacted by the spray to produce a foam.

More recently foam/spray discharge selectability is disclosed in the Tasaki et al U.S. Pat. No. 5,344,078 and the Foster et al U.S. Pat. No. 5,767,385. In these patents a foaming sleeve or bore is pivotally attached to the side of the nozzle cap on an axis generally perpendicular to the orifice axis so that it can be swung down from an idle position to close to the orifice so that the spray from the orifice contacts the sleeve and a foam discharge is produced.

The structure of some earlier selectable discharge pumps interfere with the symmetry of the pump nozzle. The selectable feature of earlier uses often requires an awkward lateral or forward projection which can readily break off or catch on things. Further, some of these earlier structures are not easy to use.

SUMMARY OF THE INVENTION

The present invention has for an object to provide a selector symmetrical about the nozzle axis, compact and easy to use. Briefly, the invention comprising a hand-activated pump having a nozzle cap rotatably disposed at the front end of the pump. The cap has a front end wall formed with a spray orifice offset from the axis. In the invention a sprayer/foamer selector wheel is rotatably amounted on the axis and adjacent the front end wall of the cap, the wheel incorporating a foam sleeve and a sprayer window offset from the axis. By manually rotating the wheel, the user can register the window or sleeve with the spray orifice to produce spray or foam.

In a modification the wheel may be provided with a plurality of alternating sleeves and windows, all offset from the axis. The attachment of the selector wheel to the nozzle cap may be by a snap-fastener-type connection disposed on the axis and serving as a spindle. The head may be integral with the cap, and the socket in the center of the wheel.

BRIEF DESCRIPTION OF THE DRAWINGS

Further objects and features of the invention will be clear to those skilled in the art from a review of the following specification and drawings, all of which present non-limiting forms of the invention. In the drawings.

DESCRIPTION OF THE PREFERRED EMBODIMENT

Figure 1:
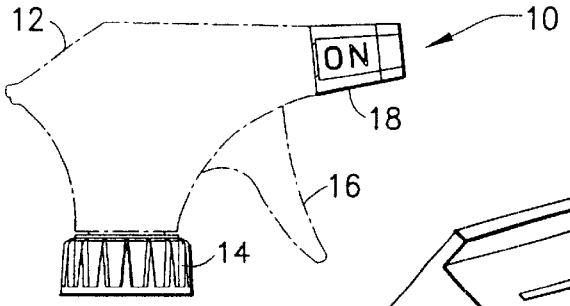
FIG. 1 is a side view of a trigger sprayer embodying the invention.

A trigger sprayer embodying the invention is generally designated 10 in FIG. 1. It comprises a body 12 including an attachment closure 14 for a container, and a pivoted trigger 16. At the forward end of the body is a nozzle including a rotatable nozzle cap 18. This cap may be rotated to turn the liquid "off" or "on".

Figure 2:
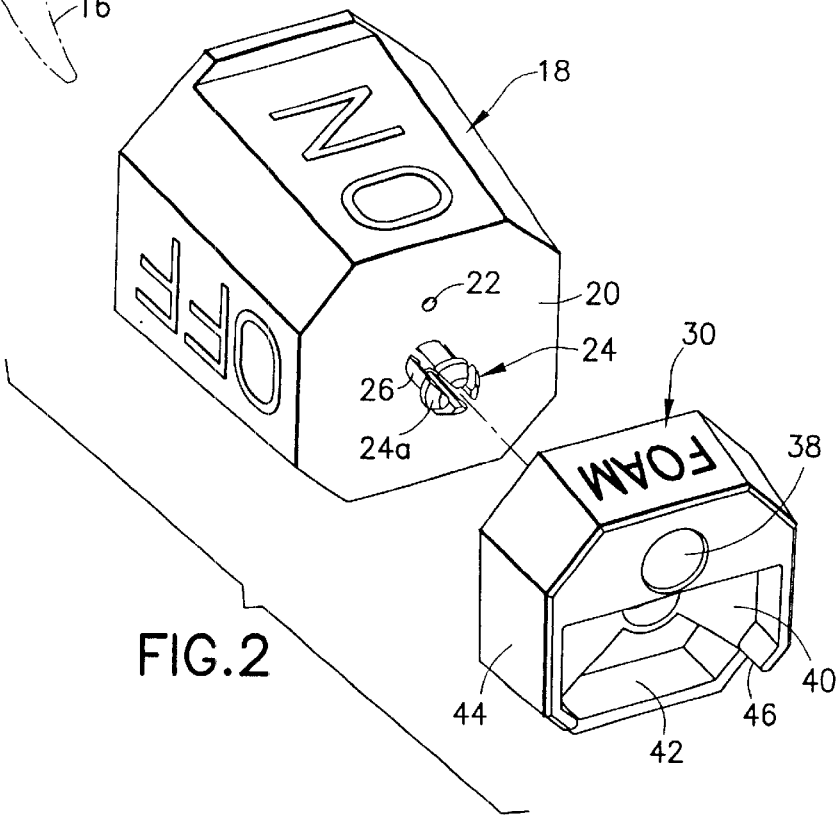
FIG. 2 is a greatly enlarged exploded perspective view of the nozzle cap and selector wheel embodying the invention.
Figure 3:
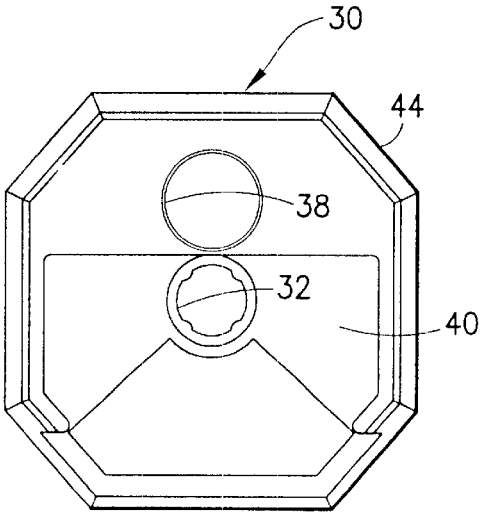
FIG. 3 is an enlarged front elevation of the selector wheel.
Figure 4:
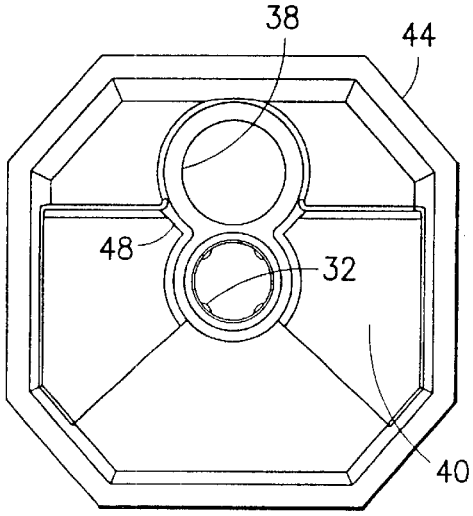
FIG. 4 is a rear view of the selector wheel.

FIG. 2, an exploded view, shows the nozzle cap 18 as a tapered polygon having a front end 20 and a spray orifice 22. On the axis a of the cap and nozzle at the front end 20 is a fastener head 24. The head 24 has a frusto-conical forward surface 24*a* and includes a neck 26. The head and neck are integrally molded with the cap and are radially slotted at 90° intervals to give the head resilience in its diametrical dimension. Preferably, the head includes a retaining shoulder 28 (FIG. 6) facing the end wall 20. The shoulder is abrupt as taught, for instance, in the U.S. Pat. No. 3,210,820 to Humiston disclosing a "one-way" snap fastener wherein the head is permanently held on the socket after first snapping on.

Figure 6:
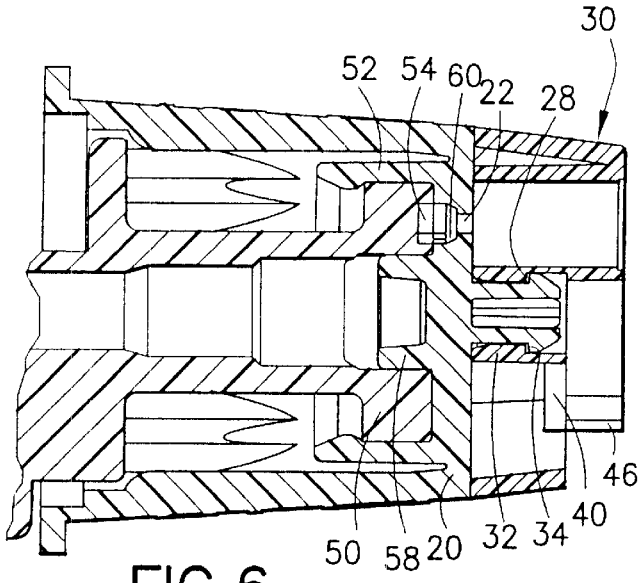
FIG. 6 is a sectional view taken on the line 6—6 of FIG. 5 and including the assembled selector wheel, cap and nozzle bushing.

Rotatably mounted on the axis of the cap 20, or more specifically, on the head 24, is the foam/spray selector wheel 30. The head 24 and neck 26 serve as a spindle for the wheel. The wheel is formed with a central opening or socket 32 which, in assembly, is pushed over the head 24. Because of its frustoconical surfaces 24*a*, the head passes the socket 32 as the head segments cam inward. The socket then snaps past the head and the wheel comes to rest against the end wall 20 with the retaining shoulder 28 engaging an adjacent annular surface of the wheel (FIG. 6).

Preferably, the selector wheel 30 also has its circumference in the form of a tapered polygon blending into the shape of the nozzle cap 18. The dimensions of the neck 26 and socket are such that the shoulder 28 on the head 24 holds the wheel in position. The wheel is freely turnable on the head/neck 26.

Formed on the wheel, a foaming sleeve 38 is disposed parallel to the axis a and spaced away from that axis at equal offset with the orifice 22 so that it may be positioned co-axial with the orifice 22. Opposite the foaming sleeve 38 is a recessed shelf 40 partly cut away to form an open window 42, the middle of the window being generally the same distance away from the axis a as the orifice 22.

Preferably, the side walls 44 of the wheel, except for the notched-out portion 46 adjacent the window 42, are the same length as the foaming sleeve 38. Thus, there are no forward projections as would be the case if the thickness of the wheel were less than the length of the sleeve 38.

In the operation of trigger sprayers embodying the invention, the nozzle cap is first turned until in the "on" indicia faces upward, causing the aforesaid internal channels to align. Next, the wheel 30 is turned so that either "foam" or "spray" (not shown) face upward, positioning either the sleeve 38 or the window 42 over the orifice 22. To assure proper annular positioning registering of the wheel, detents, (not shown) such as nibs or dimples, may be provided on the face of the end wall 20 to cooperate with corresponding dimples or nibs on the rear wall of the wheel.

To provide for additional air to reach the rear of the foaming sleeve 38, lateral inlets 48 may be provided in the rearward circumference of the sleeve.

Figure 5:
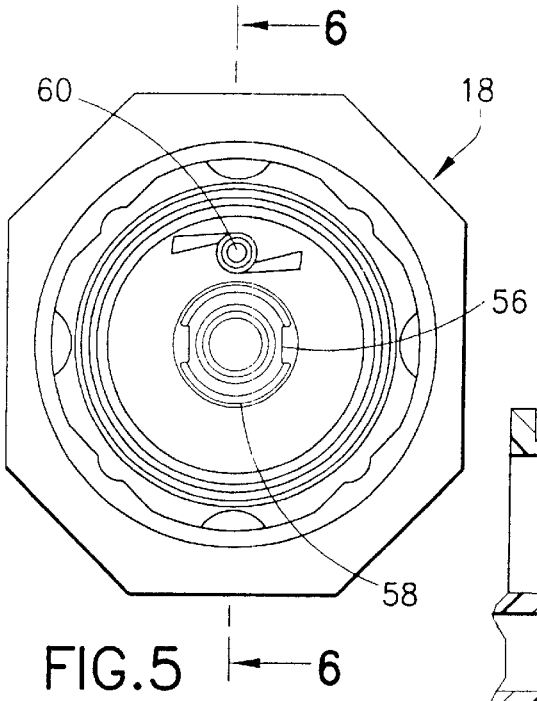
FIG. 5 is a rear view of the nozzle cap.

FIG. 5 discloses the valving structure described hereabove. The delivery tube 50 is formed at its forward end with an enlarged flange over which the annular wall 52 inside the cap snaps. The forward end of the flange 50 is formed with inlet channels 54 which, when the pump is "on", communicate to cut-out channels 56 in the inward annular boss 58 central of the cap. The end wall 20 is formed on its inside surface with swirl chamber 60 to which the channels 54 lead liquid tangentially of the chamber.

Figure 7:
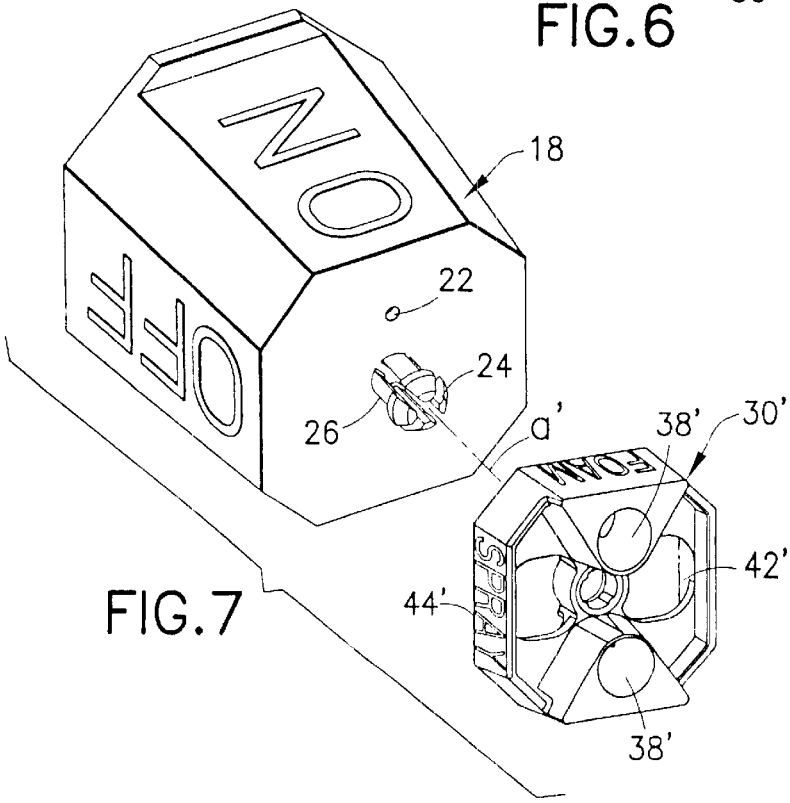
FIG. 7 is an exploded perspective view of the nozzle cap and a modified form of selector wheel.

In the FIG. 7 modification, the wheel 30' is formed with a plurality of sleeves 38' and windows 42' so that the discharge mode can be selected by rotating the wheel 30' on the axis a'. Because new modes come up every 90°, the adjustment requires less turning of the wheel than the FIG. 2 embodiment. Appropriate indicia are formed on the wall 44'. Appropriate air inlets (not shown) are notched onto the rear of the wheel for the sleeves 38' (as 48 in the first embodiment).

Variations in the invention are possible. Thus, while the invention has been shown in a limited number of embodiments, it is not so limited but is of a scope defined by the following claim language which may be broadened by an extension of the right to exclude others from making, using or selling the invention as is appropriate under the doctrine of equivalents.

What is claimed is:

1. A nozzle cap adapted to be disposed at a front end of a pump dispenser, the cap having an axis and a front end wall formed with a spray orifice offset from the axis, and a sprayer/foamer selector wheel rotatably disposed on the axis and adjacent the front end wall, the wheel having offset from the axis a foam sleeve disposed parallel to the axis and a sprayer window, the sleeve and window adapted to register selectively with the spray orifice as the wheel is rotated on the axis.

2. A nozzle cap as claimed in claim 1 wherein the axis is partly defined by a spindle on the cap and formed with a head spaced from the front end wall to cooperate with a socket on the wheel to retain the wheel on the spindle.

3. A nozzle cap as claimed in claim 1 wherein the window is a cutout portion on the wheel.

4. A nozzle cap as claimed in claim 1 in which a plurality of windows and foam sleeves are alternately spaced about the wheel.

5. A nozzle cap as claimed in claim 1 wherein a portion of the sleeve proximate the front end of the cap is notched to permit air to enter the sleeve.

6. A sprayer/foamer wheel having an axis and adapted to be rotatably mounted on a spindle and adjacent a front end wall of a nozzle cap of a pump dispenser, the wheel having offset from the axis a foam sleeve and a non-foam window adapted to register selectively with a spray orifice on the nozzle cap as the wheel is rotated on the spindle.

7. A sprayer/foamer wheel as claimed in claim 6 wherein the window is a cutout portion in the wheel.

8. A spray/former wheel as claimed in claim 6 in which a plurality of windows and foam sleeves are alternately spaced about the wheel.

* * * * *